US010522340B2

(12) United States Patent
Wilson et al.

(10) Patent No.: US 10,522,340 B2
(45) Date of Patent: Dec. 31, 2019

(54) BROADBAND LIGHT SOURCE INCLUDING TRANSPARENT PORTION WITH HIGH HYDROXIDE CONTENT

(71) Applicant: KLA-Tencor Corporation, Milpitas, CA (US)

(72) Inventors: Lauren Wilson, San Jose, CA (US); Anant Chimmalgi, San Jose, CA (US); Matthew Panzer, San Jose, CA (US); Ilya Bezel, Mountain View, CA (US)

(73) Assignee: KLA-Tencor Corporation, Milpitas, CA (US)

( * ) Notice: Subject to any disclaimer, the term of this patent is extended or adjusted under 35 U.S.C. 154(b) by 0 days.

(21) Appl. No.: 16/042,887

(22) Filed: Jul. 23, 2018

(65) Prior Publication Data

US 2018/0330937 A1 Nov. 15, 2018

Related U.S. Application Data

(62) Division of application No. 14/699,781, filed on Apr. 29, 2015, now Pat. No. 10,032,620.

(60) Provisional application No. 61/986,657, filed on Apr. 30, 2014.

(51) Int. Cl.

| | |
|---|---|
| ***H01J 61/30*** | (2006.01) |
| ***H01J 65/04*** | (2006.01) |
| ***H01J 61/02*** | (2006.01) |
| ***H05G 2/00*** | (2006.01) |

(52) U.S. Cl.

CPC ..... *H01J 61/302* (2013.01); *H01J 61/025* (2013.01); *H01J 65/04* (2013.01); *H05G 2/008* (2013.01)

(58) Field of Classification Search

None

See application file for complete search history.

(56) References Cited

U.S. PATENT DOCUMENTS

| | | | | |
|---|---|---|---|---|
| 6,143,676 | A | 11/2000 | Ohashi et al. | |
| 6,544,914 | B1 | 4/2003 | Kikugawa et al. | |
| 7,435,982 | B2 | 10/2008 | Smith | |
| 7,786,455 | B2 | 8/2010 | Smith | |
| 9,099,292 | B1 | 8/2015 | Bezel et al. | |
| 9,318,311 | B2 * | 4/2016 | Chimmalgi ..... | H01J 61/526 |

(Continued)

FOREIGN PATENT DOCUMENTS

| | | | |
|---|---|---|---|
| JP | 2009227572 | A | 10/2009 |
| WO | 2014000998 | A1 | 1/2014 |

OTHER PUBLICATIONS

Kuhn, B. et al., Screening Test of Quartz Glass for 172nm Excimer Lamps, 10th International Symposium on the Science and Technology of Light Sources LS10, Toulouse, France, Jul. 18-22, 2004, 1 page.

(Continued)

*Primary Examiner* — Ashok Patel

(74) *Attorney, Agent, or Firm* — Suiter Swantz pc llo

(57) ABSTRACT

A laser-sustained plasma light source includes a plasma lamp configured to contain a volume of gas and receive illumination from a pump laser in order to generate a plasma. The plasma lamp includes one or more transparent portions transparent to illumination from the pump laser and at least a portion of the broadband radiation emitted by the plasma. The one or more transparent portions are formed from a transparent material having elevated hydroxide content above 700 ppm.

20 Claims, 9 Drawing Sheets

(56) References Cited

U.S. PATENT DOCUMENTS

| | | | |
|---|---|---|---|
| 2007/0004579 | A1 | 1/2007 | Bookbinder et al. |
| 2007/0228288 | A1 | 10/2007 | Smith |
| 2007/0228300 | A1 | 10/2007 | Smith |
| 2008/0103038 | A1 | 5/2008 | Kawata et al. |
| 2010/0264820 | A1 | 10/2010 | Sumitomo et al. |
| 2010/0317505 | A1 | 12/2010 | Koike et al. |
| 2013/0106275 | A1 | 5/2013 | Chimmalgi et al. |
| 2013/0181595 | A1 | 7/2013 | Bezel et al. |
| 2013/0342105 | A1 | 12/2013 | Shchemelinin et al. |
| 2014/0291546 | A1 | 10/2014 | Bezel et al. |

OTHER PUBLICATIONS

Schreiber, A. et al., Radiation resistance of quartz glass for VUV discharge lamps, Journal of Physics D: Applied Physics, Institute of Physics Publishing, Aug. 19, 2005, pp. 3242-3250, vol. 38, IOP Publishing Ltd, Printed in the UK.

PCT International Search Report dated Jul. 30, 2015 for International Application No. PCT/US2015/028517, 4 pages.

Office Action dated May 7, 2019 for Japanese Patent Application No. 2016-565333.

* cited by examiner

BROADBAND LIGHT SOURCE INCLUDING TRANSPARENT PORTION WITH HIGH HYDROXIDE CONTENT

The present application is related to and claims benefit of the earliest available effective filing date from the following applications. The present application constitutes a divisional patent application of United States Patent Application entitled BROADBAND LIGHT SOURCE INCLUDING TRANSPARENT PORTION WITH HIGH HYDROXIDE CONTENT, naming Lauren Wilson, Anant Chimmalgi, Matt Panzer, and Ilya Bezel as inventors, filed Apr. 29, 2015, application Ser. No. 14/699,781, which is a regular (non-provisional) patent application of U.S. Provisional Application Ser. No. 61/986,657, filed Apr. 30, 2014, entitled UTILIZING HIGH OH GLASS FOR IMPROVED UV LAMP OR CELL LIFETIME, naming Lauren Wilson, Anant Chimmalgi, Matt Panzer and Ilya Bezel as inventors. U.S. patent application Ser. No. 14/699,781 and U.S. Provisional Patent Application No. 61/986,657 are incorporated by reference herein in their entirety.

TECHNICAL FIELD

The present invention generally relates to broadband light sources, and, more particularly, to a broadband lamp constructed to suppress the generation of color centers in the broadband lamp.

BACKGROUND

As the demand for integrated circuits having ever-smaller device features continues to increase, the need for improved illumination sources used for inspection of these ever-shrinking devices continues to grow. One such illumination source includes a broadband light source, such as a laser-sustained plasma source or a discharge light source. Broadband lamps or cells include glass portions for transmitting light into and out of the lamp or cell. Glass portions of current broadband lamps or cells form color centers as a result of defects that form in the given glass material. This effect is exacerbated in the case where the broadband lamp emits short wavelength light, such as VUV light, which tends to break bonds in the glass material. The creation of color centers in current lamps and cells causes an increase in the lamp or cell temperature and a reduction in the amount of light transmitted out of the broadband lamp or cell. Therefore, it would be desirable to provide an apparatus, system and/or method for curing defects such as those of the identified above.

SUMMARY

A broadband light source is disclosed in accordance with one or more illustrative embodiments of the present disclosure. In one illustrative embodiment, the broadband light source includes a lamp configured to contain a volume of gas. In another illustrative embodiment, the lamp includes one or more transparent portions at least partially transparent to at least a portion of broadband radiation generated within a volume of the lamp. In another illustrative embodiment, the one or more transparent portions are formed from a transparent material having a hydroxide (OH) content above 700 ppm.

A laser-sustained plasma light source is disclosed in accordance with one or more illustrative embodiments of the present disclosure. In one illustrative embodiment, the light source includes a plasma lamp configured to contain a volume of gas. In another illustrative embodiment, the plasma lamp is configured to receive illumination from a pump laser in order to generate a plasma within the volume of gas, wherein the plasma emits broadband radiation. In another illustrative embodiment, the plasma lamp includes one or more transparent portions at least partially transparent to at least a portion of illumination from the pump laser and at least a portion of the broadband radiation emitted by the plasma. In another illustrative embodiment, the one or more transparent portions are formed from a transparent material having a hydroxide content above 700 ppm.

A discharge-based light source is disclosed in accordance with one or more illustrative embodiments of the present disclosure. In one illustrative embodiment, the light source includes a discharge lamp configured to contain a volume of gas. In another illustrative embodiment, the discharge lamp comprises: a set of electrodes configured to generate a discharge within the volume of gas and one or more transparent portions at least partially transparent to at least a portion of broadband radiation associated with the discharge. In another illustrative embodiment, the one or more transparent portions are formed from a transparent material having a hydroxide (OH) content above 700 ppm.

It is to be understood that both the foregoing general description and the following detailed description are exemplary and explanatory only and are not necessarily restrictive of the invention as claimed. The accompanying drawings, which are incorporated in and constitute a part of the specification, illustrate embodiments of the invention and together with the general description, serve to explain the principles of the invention.

BRIEF DESCRIPTION OF THE DRAWINGS

The numerous advantages of the disclosure may be better understood by those skilled in the art by reference to the accompanying figures in which.

DETAILED DESCRIPTION OF THE INVENTION

Reference will now be made in detail to the subject matter disclosed, which is illustrated in the accompanying drawings.

Referring generally to FIGS. 1A through 4, a broadband light source with one or more high-OH content transparent portions is described in accordance with the present disclosure. Some embodiments of the present disclosure are directed to a broadband light source, or lamp, equipped with one or more light transmitting portions, or "transparent portions," formed from a transparent material having high hydroxide (OH) content (e.g., above 700 ppm). For the purposes of the present disclosure, the term "high-OH content" is interpreted to mean an OH content level equal to or above 700 ppm.

Figure 1A:
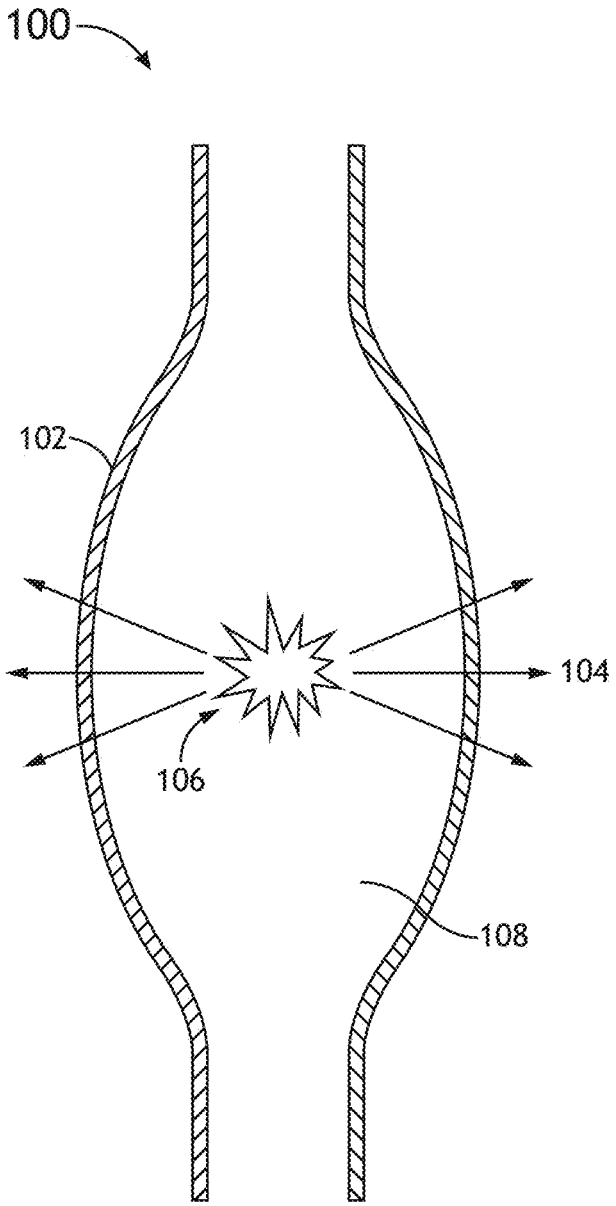
FIG. 1A is a cross-sectional view of broadband lamp including a transparent portion formed with material having high-OH content, in accordance with one embodiment of the present disclosure.

FIG. 1A illustrates a broadband lamp 100 with a transparent portion 102 formed from high-OH content glass, in accordance with one or more embodiments of the present disclosure. In one embodiment, the transparent portion 102 of the broadband lamp 100 is formed from a material (e.g., fused silica or quartz glass) transparent to at least a portion of the broadband light 104 emitted by the broadband generation mechanism (e.g., laser sustained plasma (LSP) 106, electrical discharge and the like) maintained within the volume of the broadband lamp 100. In another embodiment, the broadband lamp 100 is configured to contain a selected gas within volume 108. In another embodiment, the selected gas is excited (e.g., energized via pump light, energized via electrical voltage and the like) so as to cause emission of broadband light 104. In turn, at least a portion of the broadband light 104 is transmitted through the transparent portion 102 of the lamp 100 to one or more downstream optical elements for use in a selected application.

It is noted that the operation of a broadband lamp, particularly a broadband lamp with a significant output of short-wavelength light, such as VUV light, may lead to the development of color centers in the glass used to form the transparent portion of the broadband lamp. The development of these color centers results from a variety of defects that are created in the glass. For example, VUV light (e.g., 172 nm), emitted by the broadband source, may generate photo-induced color centers in the glass material as a result of bond breakage in the glass material caused by the VUV light. The formation of color centers in glass materials of ultraviolet light sources is discussed in detail in A. Schreiber et al., *Radiation Resistance of Quartz Glass for VUV Discharge Lamps*, J. Phys. D: Appl. Phys. 38 (2005), 3242-3250, which is incorporated herein by reference in the entirety. The behavior of light transmission in glasses is also described by B. Kuhn et al., *Screening Test of Quartz Glass for* 172 *nm Excimer Lamps,* 10th International Symposium on Science and Technology of Light Sources LS10, Toulouse, France (2004).

In one embodiment, the broadband light source 100, or lamp, includes one or more transparent portions 102 (or light transmitting portions) formed from a material having an elevated level of OH (e.g., between 700-2000 ppm). It is recognized herein that the utilization of a transparent material, such as a glass, having high-OH content inhibits the creation of color centers in ultraviolet light sources (e.g., UV, VUV, DUV and/or EUV). For example, the use of high-OH content glass as a transparent portion of the broadband lamp 100 may inhibit the generation of color centers (e.g., color centers at approximately 214 nm or 255 nm) in broadband lamp 100. It is further noted that the suppression of color centers through the use of high-OH glass may aid in avoiding an increase in temperature of the broadband lamp 100 and reduce the amount of light loss otherwise caused by color center generation.

The broadband light source 100 may include any broadband source, or lamp, structure known in the art. In one embodiment, the broadband light source 100 includes a glass bulb, as shown in FIG. 1A, formed from the high-OH material or materials of the present disclosure. It is noted herein that the shape of the broadband lamp 100 is not limited to the prolate spheroid shape depicted in FIG. 1A, which is provided merely for illustrative purposes. It is noted that the broadband lamp 100 may take on any shape known in the art. For example, the broadband lamp 100 may have a cylindrical shape, a spherical shape, a prolate spheroid shape, an oblate spheroid shape, an ellipsoid shape and the like. By way of additional example, the broadband lamp 100 may have a composite shape consisting of two or more shapes.

In another embodiment, the broadband light source 100 includes a cell equipped with a glass transmission element (e.g., flange-terminated glass cell) formed from the high-OH material or materials of the present disclosure. In another embodiment, the broadband light source 100 includes a chamber equipped with one or more glass windows formed from the high-OH material or materials of the present disclosure.

The high-OH broadband source 100 may generate broadband light through any mechanism known in the art. A variety of broadband light generation mechanisms are described throughout the present disclosure. For example, the high-OH broadband lamp 100 may include a laser-sustained plasma (LSP) light source. By way of another example, the high-OH broadband lamp 100 may include a discharge lamp.

In one embodiment, the transparent portion 102 of the broadband source 100 is formed from fused silica glass. For example, the transparent portion 102 of the broadband source 100 may be formed from, but is not limited to, fused silica glass having an OH content of at least 700 ppm. For instance, the transparent portion 102 of the broadband source 100 may be formed from, but is not limited to, fused silica glass having an OH content of 700-2000 ppm.

In one embodiment, the transparent portion 102 of the broadband source 100 is formed from fused quartz glass (e.g., electrically-fused quartz glass, flame-fused quartz glass or plasma-fused quartz glass). By way of another example, the transparent portion 102 of the broadband source 100 may be formed from, but is not limited to, quartz glass having an OH content of at least 700 ppm. For instance, the transparent portion 102 of the broadband source 100 may be formed from, but is not limited to, quartz glass having an OH content of 700-2000 ppm. Types of glasses suitable for implementation in the transparent portion 102 of broadband source 100 of the present disclosure are discussed in detail in A. Schreiber et al., *Radiation Resistance of Quartz Glass for VUV Discharge Lamps*, J. Phys. D: Appl. Phys. 38 (2005), 3242-3250, which is incorporated above by reference in the entirety.

For example, the transparent portion 102 of the broadband source 100 may be, but is not required to be, formed from one or more of the following glasses: HERAEUS SUPRASIL 1, SUPRASIL 2, AND SUPRASIL 2000 AND HERAEUS UVL, CORNING 7980, NIKON NIFS-A, JFIBER SQ0/1/T, ASHAI AQT, AQ, AQ3, OHARA 1320 AND SCHOTT LITHOSIL.

In another embodiment, the transparent portion 102 of the broadband source 100 may be formed with sufficient OH content to suppress one or more color centers across a selected wavelength range. For example, the transparent portion 102 of the broadband source 100 may be formed with sufficient OH content to suppress one or more color centers across the wavelength range including 200-300 nm. For instance, forming a transparent portion 102 of the broadband source 100 from a fused silica glass having an OH content level of greater than 700 ppm may lead to the suppression (or at least reduction) in the color centers that would otherwise develop at approximately 214 nm or 255 nm. It is noted herein that the OH content level and the suppressed color centers are not limited to those listed above, which are provided merely for illustrative purposes. It is further noted that the development of color centers in a given glass depends on a variety of factors including, but not limited to, the type of glass used, the thermal pretreatment process of the glass and the like and depend on a variety of defects that may manifest within the given glass. Various defects and associate color centers of glasses suitable for implementation in the transparent portion 102 of broadband source 100 of the present disclosure are discussed in detail in A. Schreiber et al., *Radiation Resistance of Quartz Glass for VUV Discharge Lamps*, J. Phys. D: Appl. Phys. 38 (2005), 3242-3250, which is incorporated above by reference in the entirety.

Figure 1C:
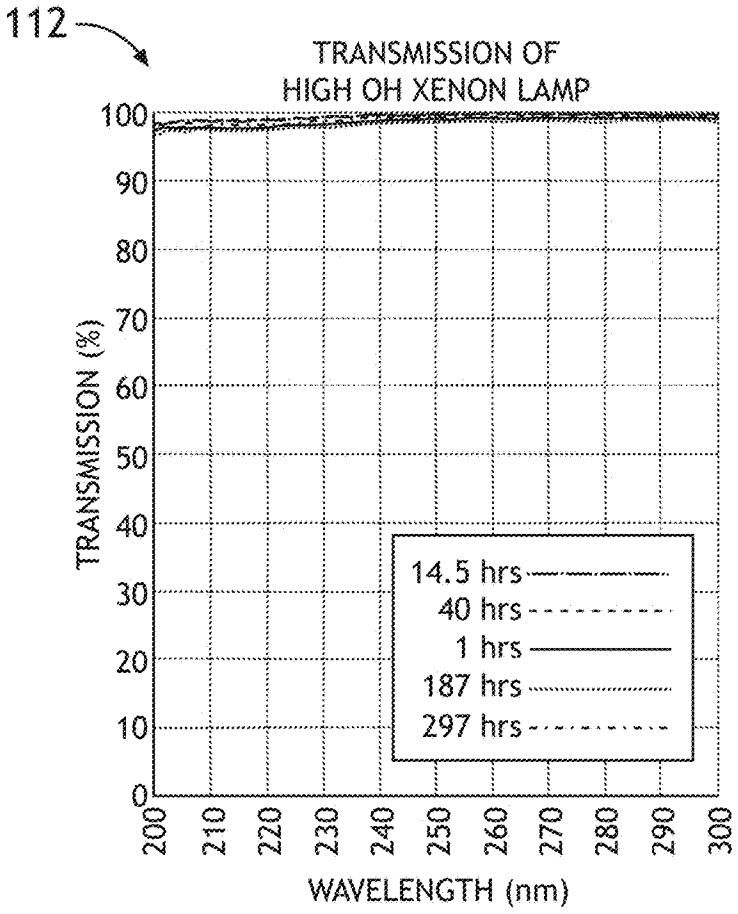
FIG. 1C depicts a graph of transmission as a function of wavelength for a high-OH xenon lamp, in accordance with one embodiment of the present disclosure.
Figure 1B:
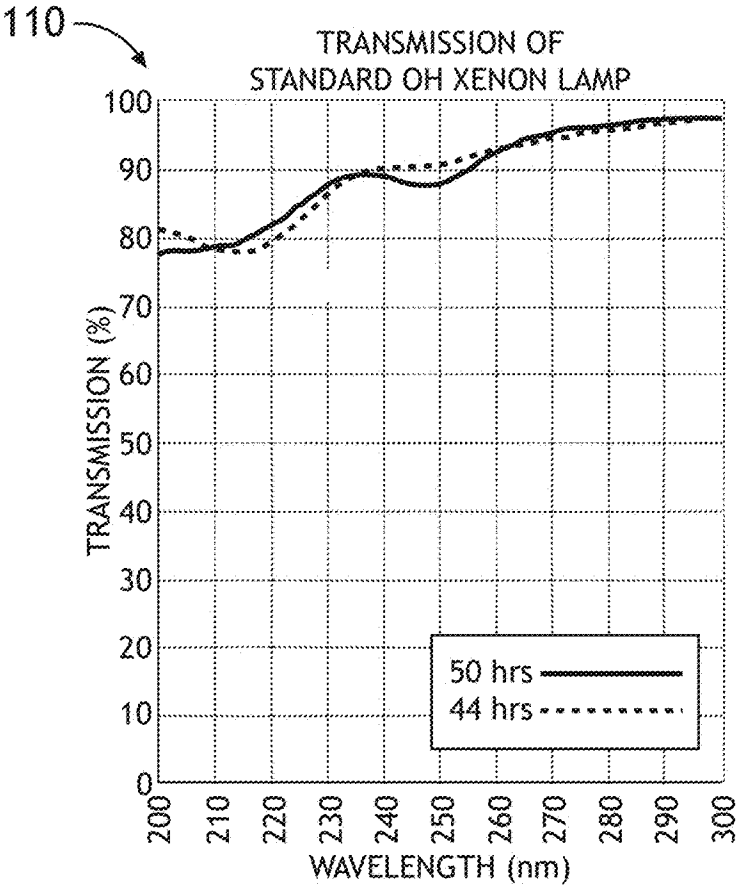
FIG. 1B depicts a graph of transmission as a function of wavelength for a low-OH xenon lamp, in accordance with one embodiment of the present disclosure.

FIGS. 1B-1G illustrate a series of light transmission data comparing the transmission of light through standard OH glass and high-OH, in accordance with one or more embodiments of the present disclosure. FIG. 1B illustrates transmission data 110 acquired from a plasma lamp formed with standard-OH glass (e.g., OH content below 700 ppm) filled with xenon gas at 10 atm. Transmission data was obtained at 44 and 50 hours of exposure across a wavelength range of 200-300 nm. The transmission data shows the development of color centers at approximately 215 nm and 245 nm.

Figure 1D:
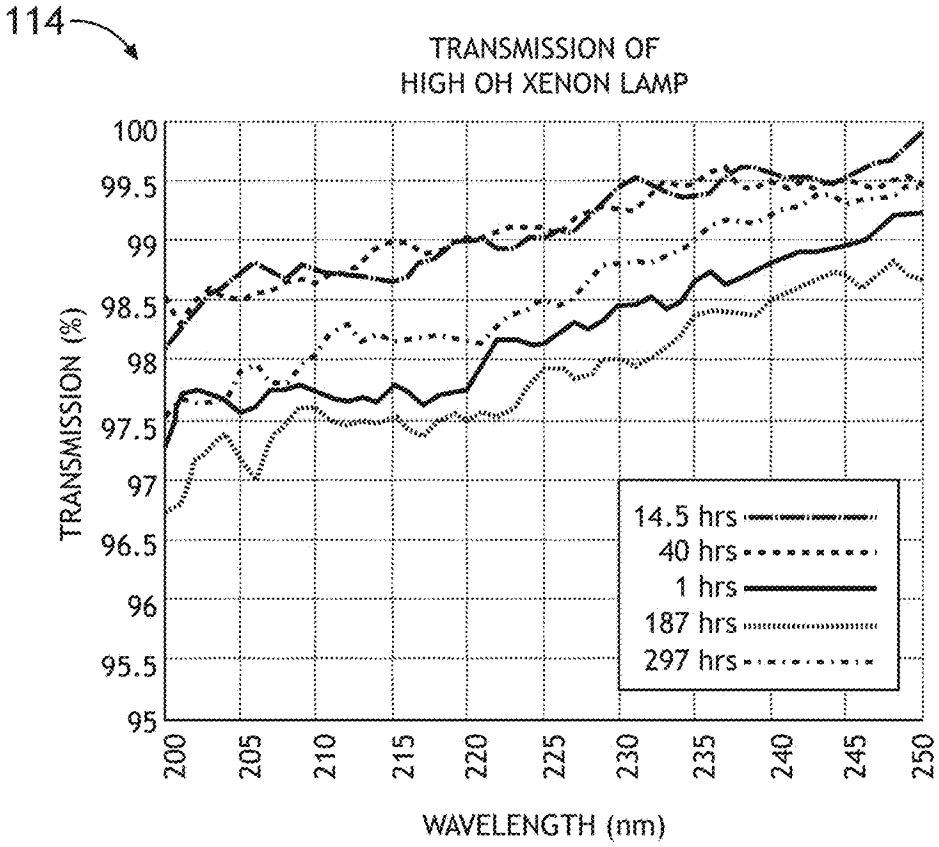
FIG. 1D depicts an exploded view of the graph of transmission as a function of wavelength for a high-OH xenon lamp, in accordance with one embodiment of the present disclosure.

FIGS. 1C and 1D illustrate transmission data 112, 114 acquired from a plasma lamp formed with high-OH glass (e.g., OH content above 700 ppm) filled with xenon. Transmission data was obtained at 1, 14.5, 40, 187 and 297 hours of exposure. In contrast to FIG. 1B, the transmission data 112, 114 of FIGS. 1C and 1D shows a suppression of the color centers that were observed in the case of standard-OH glass, clearly showing that the high-OH plasma lamp provides improved transmission of light compared to the standard-OH plasma lamp in the case of a xenon gas fill.

Figure 1F:
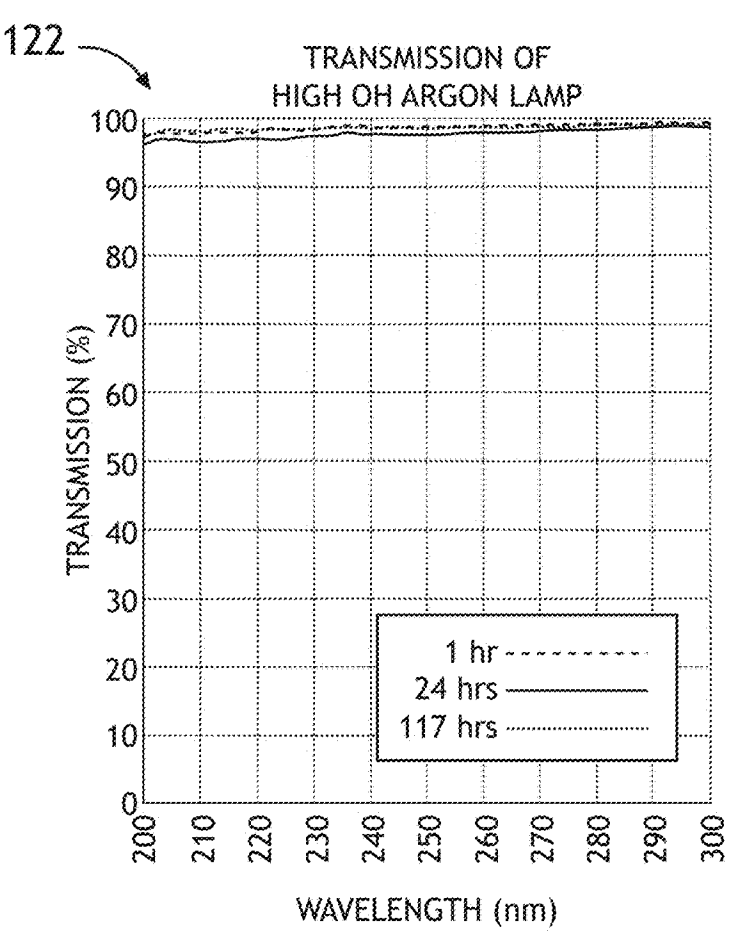
FIG. 1F depicts a graph of transmission as a function of wavelength for a high-OH argon lamp, in accordance with one embodiment of the present disclosure.
Figure 1E:
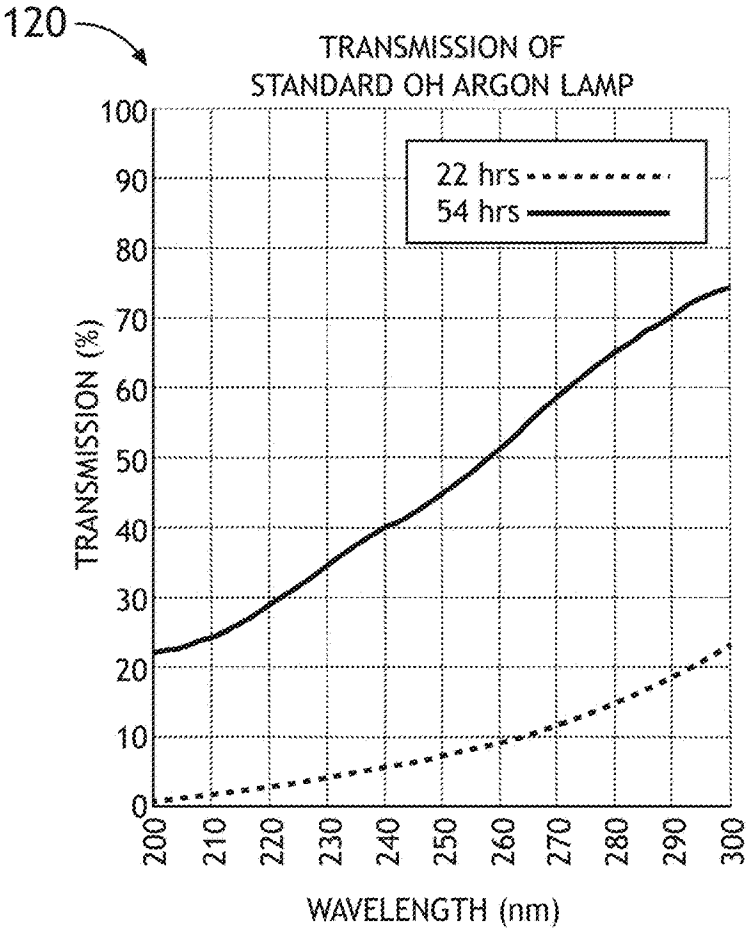
FIG. 1E depicts a graph of transmission as a function of wavelength for a low-OH argon lamp, in accordance with one embodiment of the present disclosure.
Figure 1G:
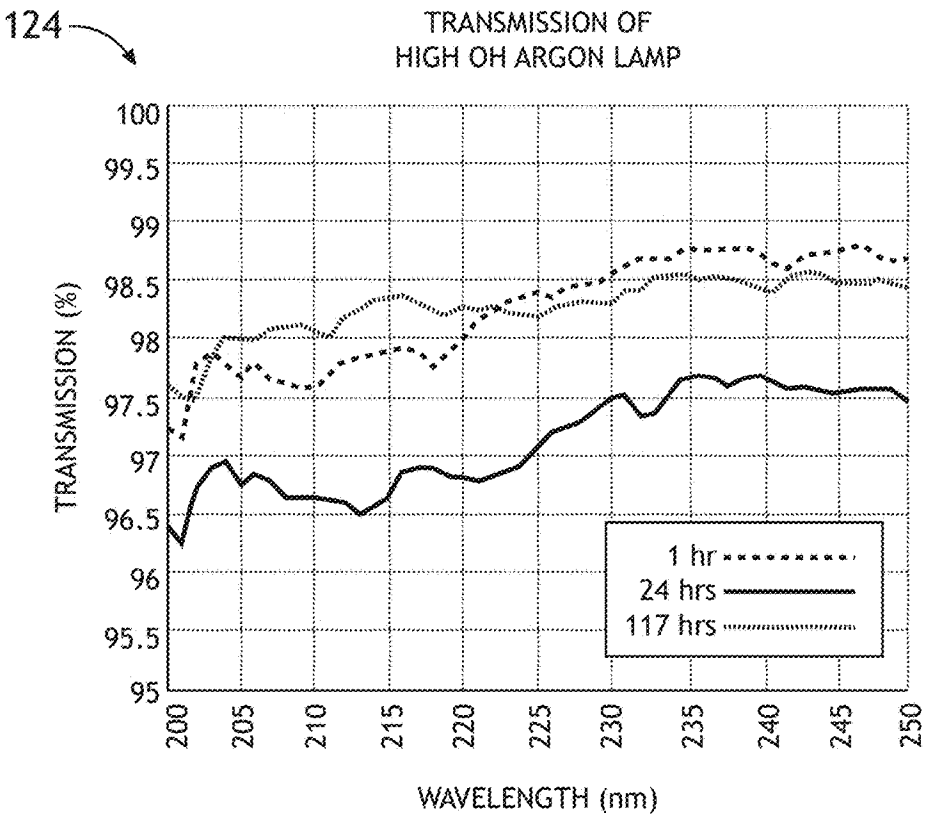
FIG. 1G depicts an exploded view of the graph of transmission as a function of wavelength for a high-OH argon lamp, in accordance with one embodiment of the present disclosure.

FIG. 1E illustrates transmission data 120 acquired from a plasma lamp formed with standard-OH glass (e.g., OH content below 700 ppm) filled with argon gas at 20 atm. Transmission data was obtained at 22 and 54 hours of exposure across a wavelength range of 200-300 nm. The transmission data shows a significant reduction of transmission across much of the 200-300 nm range. FIGS. 1F and 1G illustrate transmission data 122, 124 acquired from a plasma lamp formed with high-OH glass (e.g., OH content above 700 ppm) filled with argon. Transmission data was obtained at 1, 24 and 117 hours of exposure. In contrast to FIG. 1E, the transmission data 122, 124 of FIGS. 1F and 1G show improved light transmission across the entire 200-300 nm range compared to the standard-OH plasma lamp in the case of a argon gas fill.

It is noted herein that the present disclosure is not limited to the gas fills, gas pressure or light exposure times described above, which are provided merely for illustrative purposes.

Figure 2A:
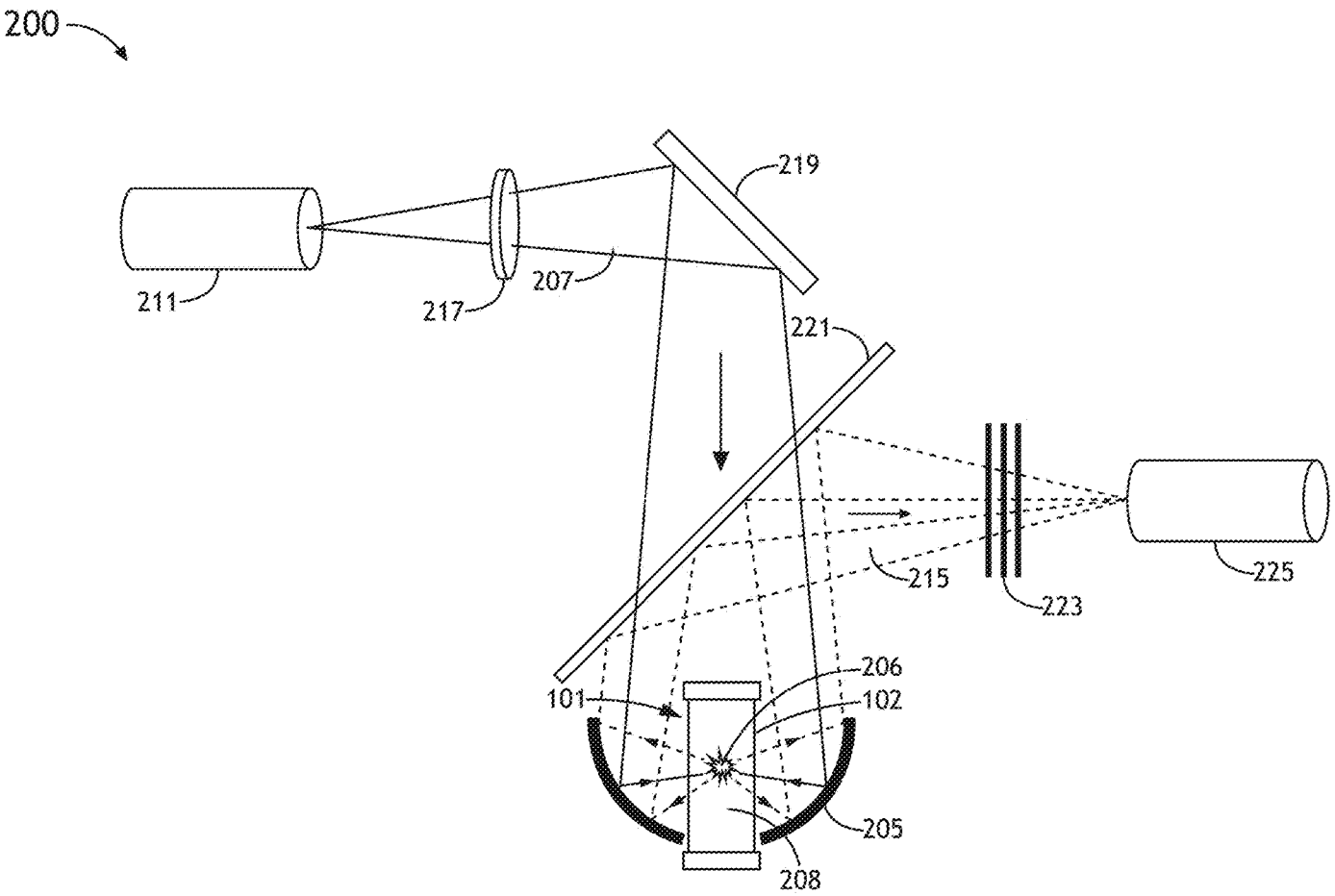
FIG. 2A is a high level schematic view of a system for generating plasma-based broadband light, in accordance with one embodiment of the present disclosure.

Referring to FIG. 2A, in one embodiment, the broadband lamp 100 includes a laser-sustained plasma lamp of a system 200 for generating broadband light with a laser-sustained plasma, in accordance with one or more embodiments of the present disclosure. In one embodiment, the plasma lamp 100 includes a high-OH content transparent portion 102. It is noted herein that the embodiments and examples provided previously herein with respect to the broadband lamp 100 of FIGS. 1A-1G should be interpreted to extend the plasma lamp 100 and system 200 of FIGS. 2A-2C.

The generation of plasma within inert gas species is generally described in U.S. patent application Ser. No. 11/695,348, filed on Apr. 2, 2007; and U.S. patent application Ser. No. 11/395,523, filed on Mar. 31, 2006, which are incorporated herein in their entirety. Various plasma cell designs are described in U.S. patent application Ser. No. 13/647,680, filed on Oct. 9, 2012, which is incorporated herein by reference in the entirety. Plasma cell and plasma bulb designs are described in U.S. patent application Ser. No. 13/741,566, filed on Jan. 15, 2013, which is incorporated herein by reference in the entirety. The generation of plasma is also generally described in U.S. patent application Ser. No. 14/224,945, filed on Mar. 25, 2014, which is incorporated by reference herein in the entirety.

In one embodiment, the system 200 includes an illumination source 211 (e.g., one or more lasers) configured to generate illumination 207 of a selected wavelength or wavelength range, such as, but not limited to, infrared radiation, visible or UV radiation. In another embodiment, the plasma lamp 100 is configured for generating, or maintaining, plasma 206. In one embodiment, the plasma lamp 100 includes one or more transparent portions 102 formed from a glass material substantially transparent to at least a portion of the illumination 207 from the pumping laser source 211 and at least a portion of the broadband emission 215 from the plasma 206.

In this regard, the transparent portion 102 of the plasma lamp 100 receives illumination from the illumination source 211 and then transmits the illumination 207 into a volume of gas 208 contained within the plasma lamp 100. In turn, the light absorbed by the gas or plasma within the lamp acts to generate, or sustain, plasma 206 within the plasma lamp 100. The illumination 207 may be delivered by the illumination source 211 into the plasma lamp 100 via any optical coupling mechanism known in the art. For example, the illumination 207 may be, but is not required to be, delivered through the transparent portion 102 of the plasma lamp 100 via fiber optic coupling or via free space coupling.

Upon absorbing illumination from illumination source 211, the plasma 206 emits broadband radiation (e.g., broadband IR, broadband visible, broadband UV, broadband DUV, broadband VUV and/or broadband EUV radiation). In another embodiment, one or more transparent portions 102 of the plasma lamp 100 are transparent to at least a portion of the broadband radiation 215 emitted by the plasma 206. In another embodiment, the one or more transparent portions 102 of the plasma lamp 100 are transparent to both illumination 207 from the illumination source 211 and broadband light 215 emitted by plasma 206.

As previously noted, the emission of high energy broadband light (e.g., VUV light) may cause the development of color centers in the material of the transparent portion 102 of the plasma lamp 100. In one embodiment, as discussed previously herein, the one or more transparent portions 102 of the plasma lamp 100 are formed with a high-OH content material, which serves to suppress the formation of color centers in the transparent portion 102 of the plasma lamp 100. In one embodiment, the transparent portion 102 of the plasma lamp 100 of system 200 may be formed from, but is not limited to, a glass having an OH content above 700 ppm. For example, the transparent portion 102 of the plasma lamp 100 of system 200 may be formed from, but is not limited to, fused silica glass having an OH content above 700 ppm. By way of another example, the transparent portion 102 of the plasma lamp 100 of system 200 may be formed from, but is not limited to, fused quartz glass having an OH content above 700 ppm. In another embodiment, the transparent portion 102 of the plasma lamp 100 of system 200 may be formed from, but is not limited to, a glass having an OH content between 700 and 2000 ppm (e.g., between 1000-1200 ppm). For example, the transparent portion 102 of the plasma lamp 100 of system 200 may be formed from, but is not limited to, fused silica glass having an OH content between approximately 700 and 2000 ppm. By way of another example, the transparent portion 102 of the plasma lamp 100 of system 200 may be formed from, but is not limited to, fused quartz glass having an OH content between 700 and 2000 ppm. In another embodiment, the transparent portion 102 of the plasma lamp 100 of system 200 may be formed from, but is not limited to, a glass having an OH content above 2000 ppm. For example, the transparent portion 102 of the plasma lamp 100 of system 200 may be formed from, but is not limited to, fused silica glass having an OH content above 2000 ppm. By way of another example, the transparent portion 102 of the plasma lamp 100 of system 200 may be formed from, but is not limited to, fused quartz glass having an OH content above 2000 ppm.

It is noted herein the plasma lamp 100 of the present disclosure may include any gas containing structure known in the art of plasma-based light sources suitable for initiating and/or maintaining a plasma 206.

Figure 2C:
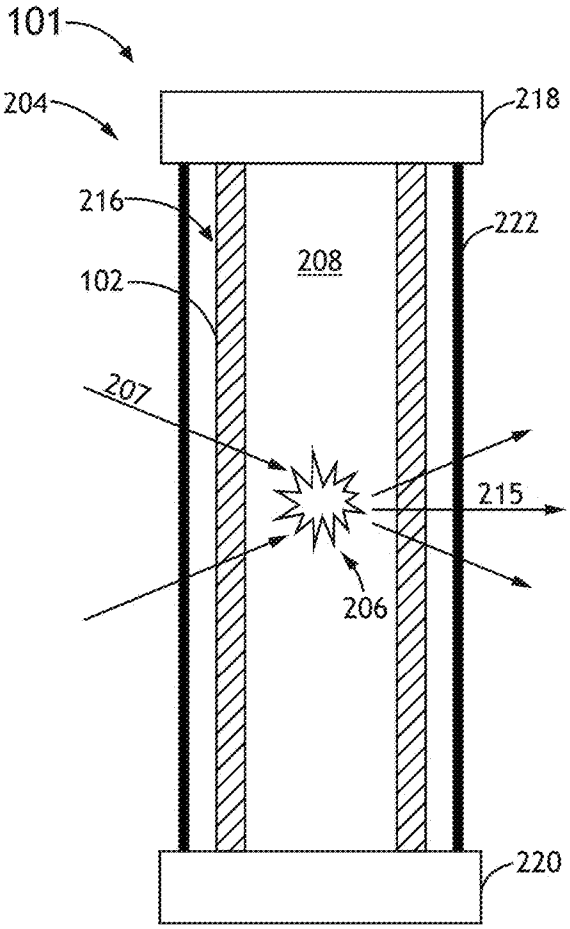
FIG. 2C is a cross-sectional view of a flanged plasma cell including a transmission element formed with high-OH content material, in accordance with one embodiment of the present disclosure.
Figure 2B:
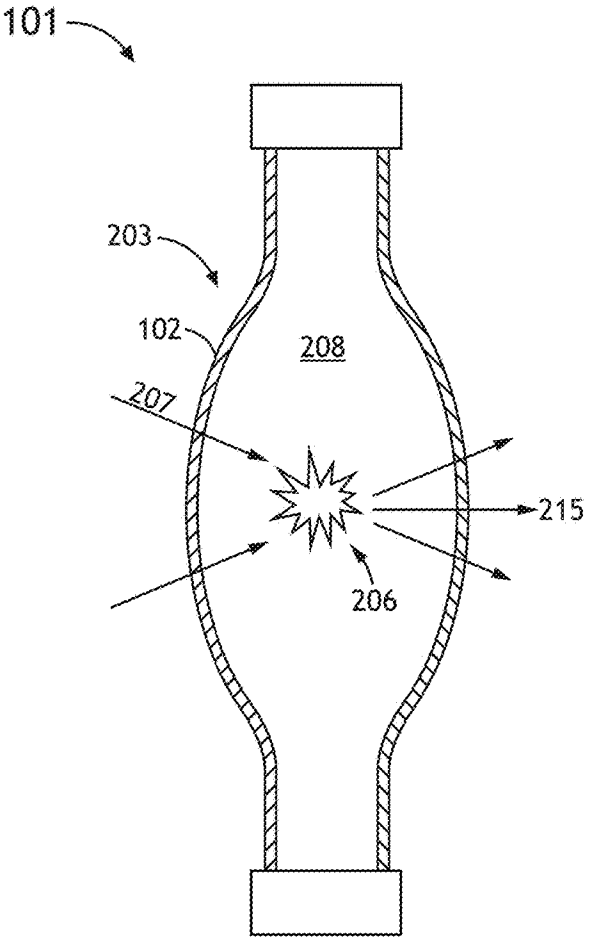
FIG. 2B is a cross-sectional view of a plasma bulb formed with high-OH content material, in accordance with one embodiment of the present disclosure.

Referring to FIG. 2B, in one embodiment, the plasma lamp 100 may include a plasma bulb 203 suitable for containing a volume of gas 208 and initiating and/or maintaining plasma 206. In this regard, the transparent portion 102 of the plasma lamp 100 may consist of the transparent portion (or wall) of the plasma bulb 203, as shown in FIG. 2B. In one embodiment, the plasma bulb 203 is suited for transmitting light 207 from the pumping source 211 into the gas 208 and further suited for transmitting broadband radiation 215 from the plasma 206 to downstream optical elements.

In one embodiment, the plasma bulb 203 may be formed from a glass material having a high OH content level, as described throughout the present disclosure. For example, the plasma bulb 203 may have an OH content level in the following, non-limiting, ranges: 700-1000 ppm, 1000-1200 ppm, 1200-2000 ppm or above 2000 ppm. In this regard, the plasma bulb 203 is capable of suppressing the formation of one or more color zones that may otherwise be created due to ultraviolet light emitted by the plasma 206.

The implementation of a plasma bulb is generally described in U.S. patent application Ser. No. 11/695,348, filed on Apr. 2, 2007; U.S. patent application Ser. No. 11/395,523, filed on Mar. 31, 2006; and U.S. patent application Ser. No. 13/647,680, filed on Oct. 9, 2012, which are each incorporated previously herein by reference in the entirety.

Referring to FIG. 2C, in one embodiment, the plasma lamp 100 may include a plasma cell 204 suitable for containing a volume of gas 208. For example, the plasma cell 204 may include, but is not required to include, a transmission element 216 suitable for containing a volume of gas 208. The transmission element 216 is suitable for initiating and/or maintaining plasma 206. In this regard, the transparent portion 102 of the plasma lamp 100 may consist of the transparent portion (or wall) of the transmission element 216, as shown in FIG. 2C. In one embodiment, the transmission element 216 is suited for transmitting light 207 from the pumping source 211 into the gas 208 and further suited for transmitting broadband radiation 215 from the plasma 206 to downstream optical elements.

In one embodiment, the transmission element 216 of the plasma cell 204 may be formed from a glass material having a high OH content level, as described throughout the present disclosure. For example, the plasma cell 204 may have an OH content level in the following, non-limiting, ranges: 700-1000 ppm, 1000-1200 ppm, 1200-2000 ppm or above 2000 ppm. In this regard, the transmission element 216 of plasma cell 204 is capable of suppressing the formation of one or more color zones that may otherwise be created due to ultraviolet light emitted by the plasma 206.

In another embodiment, the transmission element 216 may include one or more openings (e.g., top and bottom openings). In another embodiment, one or more flanges 218, 220 are disposed at the one or more openings of the transmission element 216. In one embodiment, the one or more flanges 218, 220 are configured to enclose the internal volume of the transmission element 216 so as to contain a volume of gas 208 within the body of the transmission element 216. In one embodiment, the one or more openings may be located at one or more end portions of the transmission element 216. For example, as shown in FIG. 2C, a first opening may be located at a first end portion (e.g., top portion) of the transmission element 216, while a second opening may be located at a second end portion (e.g., bottom portion), opposite of the first end portion, of the transmission element 216. In another embodiment, the one or more flanges 218, 220 are arranged to terminate the transmission element 216 at the one or more end portions of the transmission element 216, as shown in FIG. 2C. For example, a first flange 218 may be positioned to terminate the transmission element 216 at the first opening, while the second flange 220 may be positioned to terminate the transmission element 216 at the second opening. In another embodiment, the first opening and the second opening are in fluidic communication with one another such that the internal volume of the transmission element 216 is continuous from the first opening to the second opening. In another embodiment, although not shown, the plasma cell 204 includes one or more seals. In one embodiment, the seals are configured to provide a seal between the body of the transmission element 216 and the one or more flanges 218, 220. The seals of the plasma cell 204 may include any seals known in the art. For example, the seals may include, but are not limited to, a brazing, an elastic seal, an O-ring, a C-ring, a metal seal and the like. In another embodiment, the top flange 218 and bottom flange 220 may be mechanically coupled via one or more connecting rods 222, thereby sealing the transmission element 216. The generation of plasma in a flanged plasma cell is also described in U.S. patent application Ser. No. 14/231,196, filed on Mar. 31, 2014, which is incorporated by reference herein in the entirety.

Referring again to FIG. 2A, in one embodiment, the plasma lamp 100 may contain any selected gas (e.g., argon, xenon, mercury or the like) known in the art suitable for generating plasma upon absorption of suitable illumination. In one embodiment, focusing illumination 207 from the illumination source 211 into the volume of gas 208 causes energy to be absorbed through one or more selected absorption lines of the gas or plasma within the plasma lamp 100 (e.g., within plasma bulb 203 or plasma cell 204), thereby "pumping" the gas species in order to generate or sustain a plasma. In another embodiment, although not shown, the plasma bulb 203 and/or plasma cell 204 may include a set of electrodes for initiating the plasma 206 within the internal volume of the plasma bulb 203 and/or plasma cell 204, whereby pumping radiation 207 from the illumination source 211 maintains the plasma 206 after ignition by the electrodes.

It is contemplated herein that the system 200 may be utilized to initiate and/or sustain plasma 206 in a variety of gas environments. In one embodiment, the gas used to initiate and/or maintain plasma 206 may include an inert gas (e.g., noble gas or non-noble gas) or a non-inert gas (e.g., mercury). In another embodiment, the gas 208 used to initiate and/or maintain plasma 206 may include a mixture of gases (e.g., mixture of inert gases, mixture of inert gas with non-inert gas or a mixture of non-inert gases). For example, the volume of gas 208 used to generate a plasma 206 may include, but is not limited to, argon. For instance, the gas 208 may include, but is not limited to, argon. By way of another example, the volume of gas 208 used to generate a plasma 206 may include, but is not limited to, xenon. By way of another example, the volume of gas 208 used to generate a plasma 206 may include, but is not limited to, krypton. For instance, the gas 208 may include a substantially pure argon, xenon or krypton gas held at pressure in excess of 5 atm (e.g., 10-50 atm). In another instance, the gas 208 may include a mixture of argon, xenon or krypton gas with an additional gas.

It is further noted that the system 200 may be implemented with a number of gases. For example, gases suitable for implementation in the system 200 of the present disclosure may include, but are not limited, to Xe, Ar, Ne, Kr, He, $N_2$, $H_2O$, $O_2$, $H_2$, $D_2$, $F_2$, $CH_4$, one or more metal halides, a halogen, Hg, Cd, Zn, Sn, Ga, Fe, Li, Na, Ar:Xe, ArHg, KrHg, XeHg, and the like. System 200 of the present disclosure should be interpreted to extend to any architecture suitable for light-sustained plasma generation and should further be interpreted to extend to any type of gas suitable for sustaining a plasma within a plasma lamp (e.g., plasma bulb or plasma cell).

The transparent portion 102 (e.g., plasma bulb 203 or transmission element 216 of plasma cell 204) of the plasma lamp 100 may take on any shape known in the art. In the case where the plasma lamp 100 includes a transmission element 216, as shown in FIG. 2C, the transmission element 216 may have a cylindrical shape. In another embodiment, although not shown, the transmission element 216 may have a spherical, ellipsoidal, prolate spherical or oblate spherical shape. In another embodiment, although not shown, the transmission element 216 may have a composite shape. For example, the shape of the transmission element 216 may consist of a combination of two or more shapes. For instance, the shape of the transmission element 216 may consist of a spherical, ellipsoidal, prolate spherical or oblate spherical center portion, arranged to contain the plasma 206, and one or more cylindrical portions extending above and/or below the spherical, ellipsoidal, prolate spherical or oblate spherical center portion, whereby the one or more cylindrical portions are coupled to the one or more flanges 218, 220. In the case where the transmission element 216 is cylindrically shaped, as shown in FIG. 2C, the one or more openings of the transmission element 216 may be located at the end portions of the cylindrically shaped transmission element 216. In this regard, the transmission element 216 takes the form of a hollow cylinder, whereby a channel extends from the first opening (top opening) to the second opening (bottom opening). In another embodiment, the first flange 218 and the second flange 220 together with the wall(s) of the transmission element 216 serve to contain the volume of gas 208 within the channel of the transmission element 216. It is recognized herein that this arrangement may be extended to a variety of transmission element 216 shapes, as described previously herein.

In settings where the plasma lamp 100 includes a plasma bulb 203, as in FIG. 2B, the plasma bulb 203 may also take on any shape known in the art. In one embodiment, the plasma bulb 203 may have a cylindrical shape. In another embodiment, the plasma bulb 203 may have a spherical, ellipsoidal, prolate spherical or oblate spherical shape. In another embodiment, the plasma bulb may have a composite shape. For example, the shape of the plasma bulb may consist of a combination of two or more shapes. For instance, the shape of the plasma bulb may consist of a spherical, ellipsoidal, prolate spherical or oblate spherical center portion, arranged to contain the plasma 206, and one or more cylindrical portions extending above and/or below the spherical, ellipsoidal, prolate spherical or oblate spherical center portion.

In another embodiment, the system 200 includes a collector/reflector element 205 configured to focus illumination emanating from the illumination source 211 into the volume of gas 208 contained within the plasma lamp 100. The collector element 205 may take on any physical configuration known in the art suitable for focusing illumination emanating from the illumination source 211 into the volume of gas contained within the plasma lamp 100. In one embodiment, as shown in FIG. 2A, the collector element 205 may include a concave region with a reflective internal surface suitable for receiving pumping radiation 207 from the illumination source 211 and focusing the pumping radiation 207 into the volume of gas contained within the plasma lamp 100. For example, the collector/reflector element 205 may include an ellipsoid-shaped collector element having a reflective internal surface, as shown in FIG. 2A. By way of another example, the collector/reflector element 205 may include a parabolic reflector element having a reflective internal surface. By way of another example, the collector/reflector element 205 may include an aspherical reflector element having a reflective internal surface.

In another embodiment, the collector/reflector element 205 is arranged to collect broadband illumination 215 (e.g., VUV radiation, DUV radiation, EUV radiation, UV radiation and/or visible radiation) emitted by plasma 206 and direct the broadband illumination to one or more additional optical elements (e.g., filter 223, homogenizer 225 and the like). For example, the collector element 205 may collect at least one of VUV broadband radiation, DUV radiation, EUV radiation, UV radiation or visible radiation emitted by plasma 206 and direct the broadband illumination 215 to one or more downstream optical elements. In this regard, the plasma lamp 100 may deliver VUV radiation, DUV radiation, EUV radiation, UV radiation and/or visible radiation to downstream optical elements of any optical characterization system known in the art, such as, but not limited to, an inspection tool or a metrology tool. It is noted herein the plasma lamp 100 of system 200 may emit useful radiation in a variety of spectral ranges including, but not limited to, VUV radiation, DUV radiation, EUV radiation, UV radiation, and/or visible radiation.

In one embodiment, system 200 may include various additional optical elements. In one embodiment, the set of additional optics may include collection optics configured to collect broadband light emanating from the plasma 206. For instance, the system 200 may include a selective mirror 221 arranged to direct illumination from the collector element 205 to downstream optics, such as, but not limited to, a homogenizer 225, while being substantially transparent to the pump radiation 207.

In another embodiment, the set of optics may include one or more lenses (e.g., lens 217) placed along either the illumination pathway or the collection pathway of system 200. The one or more lenses may be utilized to focus (or diverge) illumination from the illumination source 211 into the volume of gas 208 within the plasma lamp 100. Alternatively, the one or more additional lenses may be utilized to focus broadband light emanating from the plasma 206 onto a selected target (not shown).

In another embodiment, the set of optics may include a turning mirror 219. In one embodiment, the turning mirror 219 may be arranged to receive pumping radiation 207 from the illumination source 211 and direct the illumination to the volume of gas 208 contained within the plasma lamp 100 via collection element 205. In another embodiment, the collection element 205 is arranged to receive illumination from mirror 219 and focus the illumination to the focal point of the collection element 205 (e.g., ellipsoid-shaped collection element), where the plasma lamp 100 is located.

In another embodiment, the set of optics may include one or more filters 223 placed along either the illumination pathway or the collection pathway in order to filter illumination prior to light entering the plasma lamp 100 or to filter illumination following emission of the light from the plasma 206. It is noted herein that the set of optics of system 200 as described above and illustrated in FIG. 2A are provided merely for illustration and should not be interpreted as limiting. It is recognized that a number of equivalent or additional optical configurations may be utilized within the scope of the present disclosure.

In another embodiment, the illumination source 211 of system 200 may include one or more lasers. In a general sense, the illumination source 211 may include any laser system known in the art. For instance, the illumination source 211 may include any laser system known in the art capable of emitting radiation in the infrared, visible or ultraviolet portions of the electromagnetic spectrum. In one embodiment, the illumination source 211 may include a laser system configured to emit continuous wave (CW) laser radiation. For example, the illumination source 211 may include one or more CW infrared laser sources.

In another embodiment, the illumination source 211 may include one or more diode lasers. For example, the illumination source 211 may include one or more diode lasers emitting radiation at a wavelength corresponding with any one or more absorption lines of the species of the gas contained within the plasma lamp 100. In a general sense, a diode laser of the illumination source 211 may be selected for implementation such that the wavelength of the diode laser is tuned to any absorption line of any plasma (e.g., ionic transition line) or any absorption line of the plasma-producing gas (e.g., highly excited neutral transition line) known in the art. As such, the choice of a given diode laser (or set of diode lasers) may depend on the type of gas contained within the plasma lamp 100 of system 200.

In another embodiment, the illumination source 211 may include an ion laser. For example, the illumination source 211 may include any noble gas ion laser known in the art. For instance, in the case of an argon-based plasma, the illumination source 211 used to pump argon ions may include an Ar+ laser.

In another embodiment, the illumination source 211 may include one or more frequency converted laser systems. For example, the illumination source 211 may include a Nd:YAG or Nd:YLF laser having a power level exceeding 100 watts. In another embodiment, the illumination source 211 may include a broadband laser. In another embodiment, the illumination source may include a laser system configured to emit modulated laser radiation or pulsed laser radiation.

In another embodiment, the illumination source 211 may include one or more lasers configured to provide laser light at substantially a constant power to the plasma 206. In another embodiment, the illumination source 211 may include one or more modulated lasers configured to provide modulated laser light to the plasma 206. In another embodiment, the illumination source 211 may include one or more pulsed lasers configured to provide pulsed laser light to the plasma.

In another embodiment, the illumination source 211 may include one or more non-laser sources. The illumination source 211 may include any non-laser light source known in the art. For instance, the illumination source 211 may include any non-laser system known in the art capable of emitting radiation discretely or continuously in the infrared, visible or ultraviolet portions of the electromagnetic spectrum.

In another embodiment, the illumination source 211 may include two or more light sources. In one embodiment, the illumination source 211 may include or more lasers. For example, the illumination source 211 (or illumination sources) may include multiple diode lasers. By way of another example, the illumination source 211 may include multiple CW lasers. In a further embodiment, each of the two or more lasers may emit laser radiation tuned to a different absorption line of the gas or plasma within the plasma lamp 100 of system 200.

Figure 3:
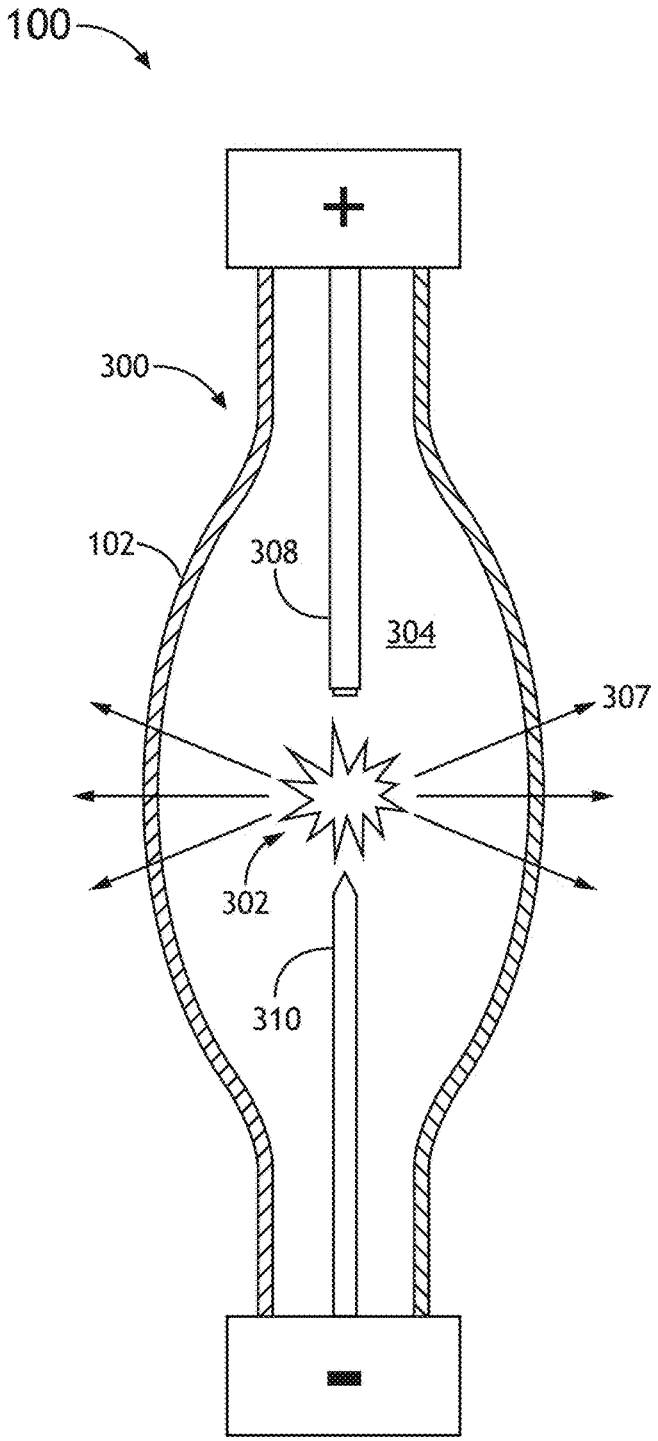
FIG. 3 is a cross-sectional view of a discharge lamp including a bulb portion formed with a high-OH content material, in accordance with one embodiment of the present disclosure.

Referring now to FIG. 3, in one embodiment, the broadband lamp 100 may include a discharge lamp 300. FIG. 3 illustrates a discharge lamp 300 equipped with a high-OH transparent portion 102, in accordance with one or more embodiments of the present disclosure. While much of the present disclosure has described the implementation of the high-OH transparent portion 102 in the context of a laser-pumped plasma source (e.g., plasma lamp 100), the present disclosure is not limited to such a configuration. The high-OH transparent portion 102 of the present disclosure may be implemented in the context of any broadband light generation setting where the suppression of color zones or the improvement of transmission is desired.

It is noted herein that the various embodiments and examples of the plasma lamp 100 described previously herein with respect to FIGS. 1A-FIG. 2C should be interpreted to extend to the discharge lamp 300 of FIG. 3. For instance, the materials used to fabricate the discharge lamp 300 may take similar forms as those described previously herein in the context of plasma lamp 100. In one embodiment, the transparent portion 102 of the discharge lamp 300 is formed from fused silica glass having an OH content level above 700 ppm (e.g., between 700-2000 ppm). In another embodiment, the transparent portion 102 of the discharge lamp 300 is formed from quartz glass having a OH content level above 700 ppm (e.g., between 700-1000 ppm, between 1000-1200 ppm, between 1200-2000 ppm or above 2000 ppm).

It is noted herein that the discharge lamp 300 of the present disclosure may take on the form of any discharge lamp known in the art and is not limited to the configuration depicted in FIG. 3. In one embodiment, the discharge lamp 300 is an arc lamp and includes a set of electrodes 308, 310. For example, the discharge lamp 300 may include, but is not limited to, the anode 308 and cathode 310, as depicted in FIG. 3, configured to generate broadband light 307 through the excitation 302 of the gas 304.

It is noted herein that the gas 304 used in the arc lamp may include any gas used in the art of discharge lamps. For example, the gas 304 may include, but is not limited to, one or more of Xe, Hg, Xe—Hg, Ar and the like.

Figure 4:
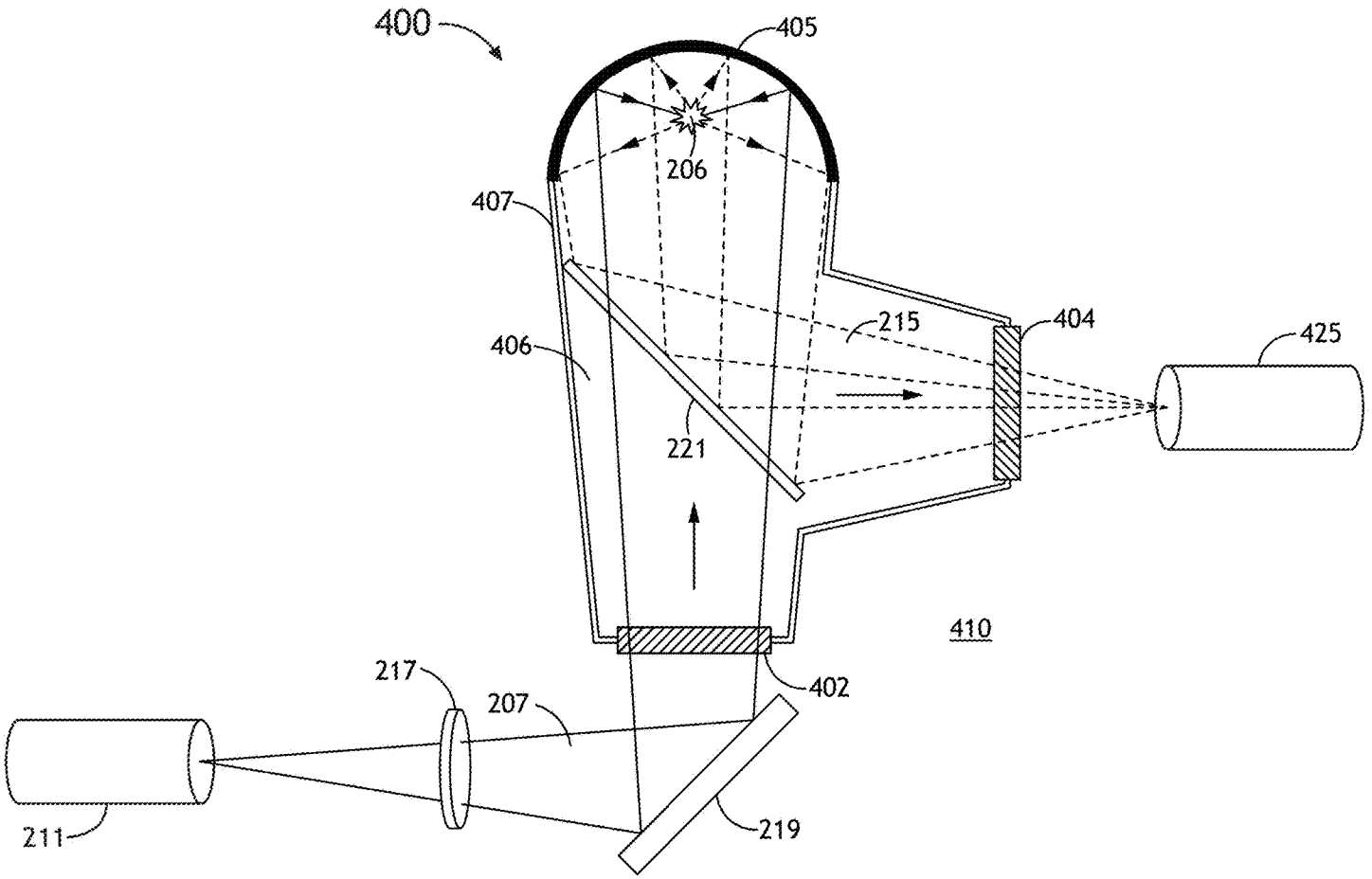
FIG. 4 is a high-level schematic view of a bulb-less system for generating plasma-based broadband light including one or more optical surfaces formed with high-OH content material, in accordance with one embodiment of the present disclosure.

FIG. 4 illustrates a bulb-less source 400 for generating plasma-based broadband light, in accordance with one or more embodiments of the present disclosure. While much of the present disclosure has focused on the implementation of the high-OH content transparent portion 102 in the context of plasma lamp 100 or arc lamp 300, where a gas environment is maintained in a small volume, these configurations are not limitations on the present disclosure. It is recognized herein that the high-OH content transparent portion 102 may be implemented in any broadband light generation setting where improved light transmission is desired. The bulb-less illumination source 400 illustrates one such environment. The bulb-less light source 400 is configured to establish and maintain plasma 206 within a gas 406 contained in a gas containment structure 407 (e.g., chamber 407). For example, as shown in FIG. 4, a plasma 206 may be established and maintained in the gas 406 contained within the volume defined by the gas containment structure 407 (e.g., chamber) and/or the collector element 405.

In another embodiment, the gas containment structure 407 is operably coupled to the collector element 405. For example, as shown in FIG. 4, the collector element is disposed on an upper portion of containment structure 407. By way of another example, although not shown, the collector element 405 may be disposed inside of the gas containment structure 407. It is noted herein that the present disclosure is not limited to the above description or the depiction of source 400 in FIG. 4 as it is contemplated herein that source 400 may encompass a number of bulb-less configurations suitable for initiating and/or maintaining a plasma in accordance with the present disclosure.

The generation of plasma in a bulb-less light source is generally described in U.S. patent application Ser. No. 14/224,945, filed on Mar. 25, 2014, which is incorporated above in the entirety. A bulb-less laser sustained plasma light source is also generally described in U.S. patent application Ser. No. 12/787,827, filed on May 26, 2010, which is incorporated herein by reference in the entirety.

It is noted herein that the various embodiments and examples of the plasma lamp 100 and discharge lamp 300 described previously herein with respect to FIGS. 1A-3 should be interpreted to extend to the bulb-less source 400 of FIG. 4. For instance, the materials used to fabricate the transparent optical elements of the source 400 may take similar forms as those described previously herein in the context of plasma lamp 100 and discharge lamp 300.

In one embodiment, the source 400 includes one or more transparent portions 402, 404. In another embodiment, the one or more transparent portions 402, 404 may be formed, but are not limited to, a glass material having high OH-content, such as any of the materials described throughout the present disclosure. For example, the one or more transparent portions 402, 404 may include, but are not limited to, windows 402, 404 formed from a glass material (e.g., fused silica glass or fused quartz glass) having an OH content above 700 ppm (e.g., between 700-1000 ppm, between 1000-1200 ppm, between 1200-2000 ppm or above 2000 ppm).

In one embodiment, the source 400 includes an input window 402 for receiving pumping radiation 207 from the pumping source 211. In another embodiment, the source 400 includes an output window 404 for transmitting broadband illumination 215 from the plasma 206 to downstream optical components (e.g., homogenizer 425). It is noted herein that the present disclosure is not limited to the particular configuration of source 400. It is recognized herein that the high-OH content glass of the present disclosure may be used to form any transparent optical surface used to couple pumping radiation to the plasma and/or used to couple broadband radiation to downstream optics.

While the present disclosure has focused on the implementation of the high-OH transparent portion 102 of the broadband sources 100, 300 and 400 in the context of broadband light generation in sample (e.g., wafer) inspection tools, it is contemplated herein that the embodiments of the present disclosure may be extended to any optical setting where the suppression of color zones is advantageous. For example, in addition to broadband inspection, it is recognized herein that the high-OH content material (e.g., high-OH fused silica glass or high-OH quartz glass) of the present disclosure may be used to form one or more transparent optical components of any scatterometer, reflectometer, ellipsometer or optical metrology tool known in the art.

The herein described subject matter sometimes illustrates different components contained within, or connected with, other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "connected", or "coupled", to each other to achieve the desired functionality, and any two components capable of being so associated can also be viewed as being "couplable", to each other to achieve the desired functionality. Specific examples of couplable include but are not limited to physically interactable and/or physically interacting components.

It is believed that the present disclosure and many of its attendant advantages will be understood by the foregoing description, and it will be apparent that various changes may be made in the form, construction and arrangement of the components without departing from the disclosed subject matter or without sacrificing all of its material advantages.

The form described is merely explanatory, and it is the intention of the following claims to encompass and include such changes. Furthermore, it is to be understood that the invention is defined by the appended claims.

What is claimed:

1. A broadband light source comprising:

a lamp configured to contain a volume of gas, the lamp including one or more transparent portions being at least partially transparent to at least a portion of broadband radiation generated within a volume of the lamp, wherein the one or more transparent portions are formed from a transparent material having a hydroxide (OH) content above 1200 ppm.

2. The broadband light source of claim 1, wherein the transparent portion of the lamp is formed from at least one of fused silica glass or quartz glass.

3. The broadband light source of claim 1, wherein the gas comprises:

at least one of an inert gas, a non-inert gas and a mixture of two or more gases.

4. The broadband light source of claim 1, wherein the transparent portion of the lamp is formed from a transparent material having an OH content between 1200 and 2000 ppm.

5. The broadband light source of claim 1, wherein the transparent portion of the lamp is formed from a transparent material having an OH content above 2000 ppm.

6. A laser-sustained plasma light source comprising:

a plasma lamp configured to contain a volume of gas, the plasma lamp configured to receive illumination from a pump laser in order to generate a plasma within the volume of gas, wherein the plasma emits broadband radiation, the plasma lamp including one or more transparent portions being at least partially transparent to at least a portion of the illumination from the pump laser and at least a portion of the broadband radiation emitted by the plasma, wherein the one or more transparent portions are formed from a transparent material having a hydroxide (OH) content above 1200 ppm.

7. The laser-sustained plasma light source of claim 6, wherein the gas comprises:

at least one of an inert gas, a non-inert gas and a mixture of two or more gases.

8. The laser-sustained plasma light source of claim 6, wherein the plasma lamp comprises:

a plasma bulb.

9. The laser-sustained plasma light source of claim 6, wherein the plasma lamp comprises:

a plasma cell.

10. The laser-sustained plasma light source of claim 9, wherein the plasma cell comprises:

a transmission element; and one or more flanges disposed at one or more openings of the transmission element, the one or more flanges configured to enclose an internal volume of the transmission element in order to contain a volume of the gas within the transmission element.

11. The laser-sustained plasma light source of claim 6, wherein the transparent portion of the plasma lamp is formed from at least one of fused silica glass or quartz glass.

12. The laser-sustained plasma light source of claim 6, wherein the transparent portion of the plasma lamp is formed from a transparent material having an OH content above 2000 ppm.

13. The laser-sustained plasma light source of claim 6, wherein the transparent portion of the plasma lamp is formed from a transparent material having an OH content between 1200 and 2000 ppm.

14. A broadband light source comprising:

a discharge lamp configured to contain a volume of gas, wherein the discharge lamp comprises:

a set of electrodes configured to generate a discharge within the volume of gas; and one or more transparent portions being at least partially transparent to at least a portion of broadband radiation associated with the discharge, wherein the one or more transparent portions are formed from a transparent material having a hydroxide (OH) content above 1200 ppm.

15. The broadband light source of claim 14, wherein the gas comprises:

at least one of an inert gas, a non-inert gas and a mixture of two or more gases.

16. The broadband light source of claim 14, wherein the transparent portion of the discharge lamp is formed from a transparent material having an OH content above 2000 ppm.

17. The broadband light source of claim 14, wherein the discharge lamp comprises:

an arc lamp.

18. The broadband light source of claim 14, wherein the transparent portion of the discharge lamp is formed from at least one of fused silica glass or quartz glass.

19. The broadband light source of claim 14, wherein the transparent portion of the discharge lamp is formed from a transparent material having an OH content between 1200 and 2000 ppm.

20. A broadband light source comprising:

a lamp configured to contain a volume of gas, the lamp including one or more transparent portions being at least partially transparent to at least a portion of broadband radiation generated within a volume of the lamp, wherein the one or more transparent portions are formed from a transparent material having a hydroxide (OH) content above 1000 ppm to suppress formation of one or more color centers in at least one of ultraviolet, deep ultraviolet, vacuum ultraviolet, or extreme ultraviolet portions of a electromagnetic spectrum in the one or more transparent portions of the lamp.

* * * * *